United States Patent [19]

Orlando

[11] Patent Number: 4,679,736

[45] Date of Patent: Jul. 14, 1987

[54] ROTARY MILL AND A METHOD OF CHARGING THE MILL

[75] Inventor: John J. Orlando, Rivervale, N.J.

[73] Assignee: Inco Alloys International, Inc., Huntington, W. Va.

[21] Appl. No.: 712,570

[22] Filed: Mar. 15, 1985

[51] Int. Cl.[4] ..... B02L 23/02; B02L 17/18

[52] U.S. Cl. ..... 241/25; 241/30; 241/171; 241/180; 241/DIG. 14

[58] Field of Search ..... 241/25, 30, 186 R, 186.2, 241/171, 179, DIG. 14; 222/1, 190, 152, 559, 563

[56] References Cited

U.S. PATENT DOCUMENTS 1,781,648 11/1930 Mapother, Jr. ..... 241/DIG. 14 X
2,805,827 9/1957 Pierce .
3,212,723 10/1965 Maeder et al. .
3,434,669 3/1969 Di Giambattista .

FOREIGN PATENT DOCUMENTS 834635 3/1952 Fed. Rep. of Germany .

OTHER PUBLICATIONS

Howard E. Kremers, "Rare Earth Metals", *Rare Metals Handbook*, 1961, pp. 363–395.
Catalog B-8 of Paul O. Abbe Inc., entitled Ball & Pebble Mills.

*Primary Examiner*—Timothy V. Eley
*Attorney, Agent, or Firm*—Raymond J. Kenny; Miriam W. Leff

[57] ABSTRACT

A rotary mill is provided with an improved loading means for charging material to the mill. The loading means is particularly adaptable for charging a batch-type rotary mill in a protective environment when, as part of a loading assembly of this invention, it is provided with removable plug and loading conduit members which can be interchanged without exposing the mill or charge material to air during the loading of the mill.

12 Claims, 4 Drawing Figures

ROTARY MILL AND A METHOD OF CHARGING THE MILL

FIELD OF INVENTION

This invention relates to an improved system for charging materials to a container. More particularly it relates to a system for charging particulate material to a batch-type rotary mill under controlled environmental conditions.

BACKGROUND OF INVENTION

In milling certain types of materials it is often necessary or desirable to have a positive control of the atmosphere within the mill at all times. For example, readily oxidizable materials such as aluminum, titanium, magnesium, lithium and fine powders of many compositions are combustible or even explosive under certain conditions or they may be contaminated by the presence of air. In milling such materials the control of the atmosphere must extend to charging and discharging of the mill without opening the mill to air.

The problems encountered in milling powders are particularly troublesome in the mechanical alloying of readily oxidizable metals such as aluminum, magnesium and lithium. Mechanical alloying has been described in detail in the literature and in patents. U.S. Pat. Nos. 3,740,210, 3,816,080 and 3,837,930, for example, involve the mechanical alloying of aluminum alloys and other composite materials containing aluminum. In the practice of mechanical alloying the components of the product are charged in powder form into a high energy milling device such as a ball mill where, in an environment free of or reduced in amount of free or combined oxygen, the powders that are dry or substantially dry are ground down to a very fine size initially, prior to particle agglomeration in the latter stages of the process. This initial grinding increases the total surface area of the metallic powders significantly. Since any freshly exposed surface is not oxidized, it is very hungry for oxygen to the extent that the powders in this condition will burn and/or might explode spontaneously if exposed to air. Thus, any port in the mill, for example, for charge or discharge of powders, is a source of potential danger from the standpoint of the quality of the product produced and the possibility of a fire and/or an explosion.

The present invention is particularly useful for charging mills in a manner which will protect the charge material and the environment in the mill during loading of the mill. The system is also designed to minimize the problem of exposure to the environment during operation of the mill. For that reason the invention is described herein with reference to metal powders which are readily oxidized and are prepared as dispersion strengthened materials or alloys by powder metallury routes. Of necessity the milling of such materials must be carried out in a controlled atmosphere. It will be understood, however, that the present invention is not restricted to the processing of any materials or any particular milling or grinding apparatus. The loading design lends itself to a wider application. In ball mills, for example, it has been conventional to provide loading devices which are normal to the mill; that is when the mill shell is positioned for loading the loading device is in a vertical position with the charge port at the top of the shell. In the improved design of this invention the loading device is in a vertical position when the mill shell is rotated so that the port for entry of the charge material is on the side of the mill, with unencumbered entry for the feed material into the shell.

The charging system of the present invention can be incorporated into existing mills. Improved means for discharging a mill which can be used are disclosed in co-pending U.S. applications Ser. Nos. 712,703 and 712,704, now Pat. No. 4,603,814, filed simultaneously herewith.

STATEMENT OF THE INVENTION

In accordance with the present invention a system is provided for charging material to a rotary mill comprising: (a) a hollow rotatably mounted shell, (b) at least one charging orifice located in said shell and (c) loading means sealably secured on the shell over each charging orifice, said loading means comprising a loading conduit with a port of entry at one end and an exit port at the other end, the exit port being aligned and forming a passageway with the orifice for charging material into the shell, and said loading means being disposed on the shell to have a substantially vertical loading position when located on the side of the mill with the port of entry essentially above the exit port.

Preferably the charging orifice is located in the peripheral wall of the shell. In one advantageous embodiment of the present invention the charging system is incorporated in a batch-type mill which is capable of operating under a controlled environment, and the loading means is part of a loading assembly designed for charging material to the shell under seal to the atmosphere. The loading assembly comprises the loading means described above, a removable sealable plug member for insertion into the loading means in a sealed relationship therewith relative to the atmosphere; a removable, sealable charge tube assembly for insertion into the loading means in a sealed relationship therewith relative to the atmosphere; a receptacle for charge material securable to the loading means; and conduit valve means associated with the loading conduit for interchanging the removable plug and removable charge tube assembly without breaking the seal in the loading means with respect to the atmosphere.

In a preferred embodiment a portion of the loading means is provided with a retaining section ahead of the conduit valve means for the loading conduit, the retaining section being provided for maintaining the plug member or the sealable charge tube assembly in sealed relationship with the loading conduit while the valve means for the loading conduit is moved to the open position. The sealable charge tube assembly, which is provided with a nozzle portion for insertion into the the loading conduit, and a charge receptacle for the charge material. The charge receptacle (also referred to herein as a charge container) is equipped with a valve means for retaining the charge material in a protective atmosphere in the charge tube assembly, the charge tube valve means being maintained closed until a seal in the loading conduit is established.

Before loading the mill for operation under seal, it is advantageous to establish the desired environment in the shell, e.g. by evacuation and/or by use of a purge gas, and/or by establishment of a suitable gaseous environment. To charge the mill, the loading means is in position when it is at the side of the mill. In the location the loading conduit is essential vertical. During operation of the mill a plug member is secured in the loading conduit. Means are provided to close the conduit valve means before the plug member is removed and to replace the plug member with the charge tube assembly while the conduit valve means is in the closed position. The charge container and charge tube assembly are provided with means to retain the charge material under seal within the charge container. To charge the mill the conduit valve means and the charge tube valve are placed in the open position. For minimizing the retention of powder in the loading conduit, the inner configuration of the loading conduit can be designed free of encumbrances to material passing into the shell.

The material processed in the mill may comprise elements, compounds, mixtures, alloys, ceramics and combinations thereof. Examples of elements which may be present as major or minor constituents of the product are nickel, copper, zinc, titanium, zirconium, niobium, molybdenum, vanadium, tin, aluminium, silicon, chromium, magnesium, lithium, iron, yttrium and rare earths, e.g. cerium and lanthanum; examples of compounds are oxides, nitrides and/or carbides of aluminum, titanium, magnesium, yttrium, cerium and lanthanum; examples of alloys are master alloys of aluminum-lithium and aluminum-magnesium. The present invention is particularly useful when the material to be processed must be charged to and/or processed in a mill under a controlled atmosphere.

The invention is particularly advantageous for processing in a grinding mill metal powders which are readily oxidized and are prepared as dispersion strengthened materials or alloys by powders metallurgy routes. Of necessity the milling of such materials must be carried out in a controlled atmosphere, e.g. in a hermetically sealed or a purgative atmosphere, or in an environment of controlled gas or gas flow. However, it will be understood that the present invention is especially useful, generally, for processing in a mill any materials where a controlled atmosphere is required or beneficial. For example, the present invention can be used advantageously for preparing by a powder metallurgy route dispersion strengthened alloys, e.g., having nickel, copper, iron, titanium, magnesium, chromium or aluminum as a major constituent.

BRIEF DESCRIPTION OF DRAWING

A further understanding of the invention and its advantages will become apparent from the following description taken in conjunction with the accompanying drawing in which.

DESCRIPTION OF A PREFERRED EMBODIMENT

In a preferred embodiment the charging system is used to feed a particulate material to a ball mill and the material is processed under a protective and controlled environment.

Figure 2:
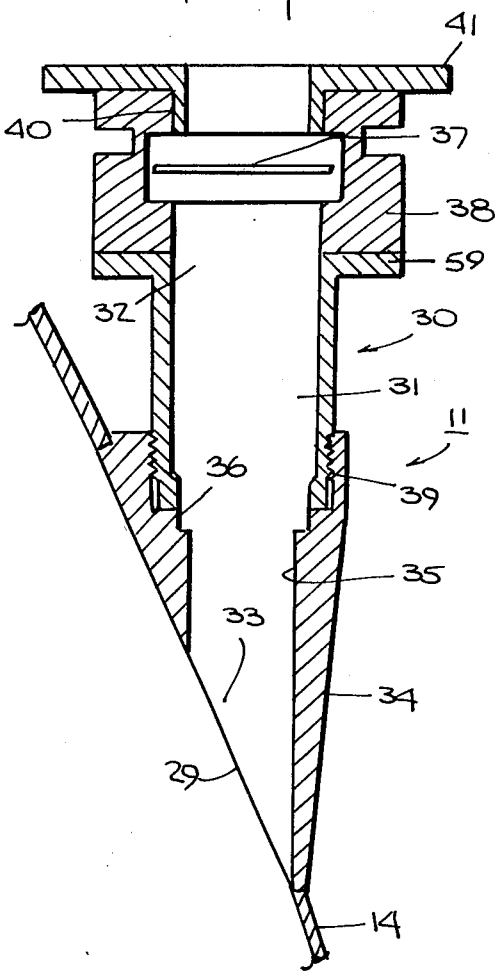
FIG. 2 is a schematic cross-sectional version of a charge portion of the mill, showing a loading means on the shell in accordance with the present invention.
Figure 1:
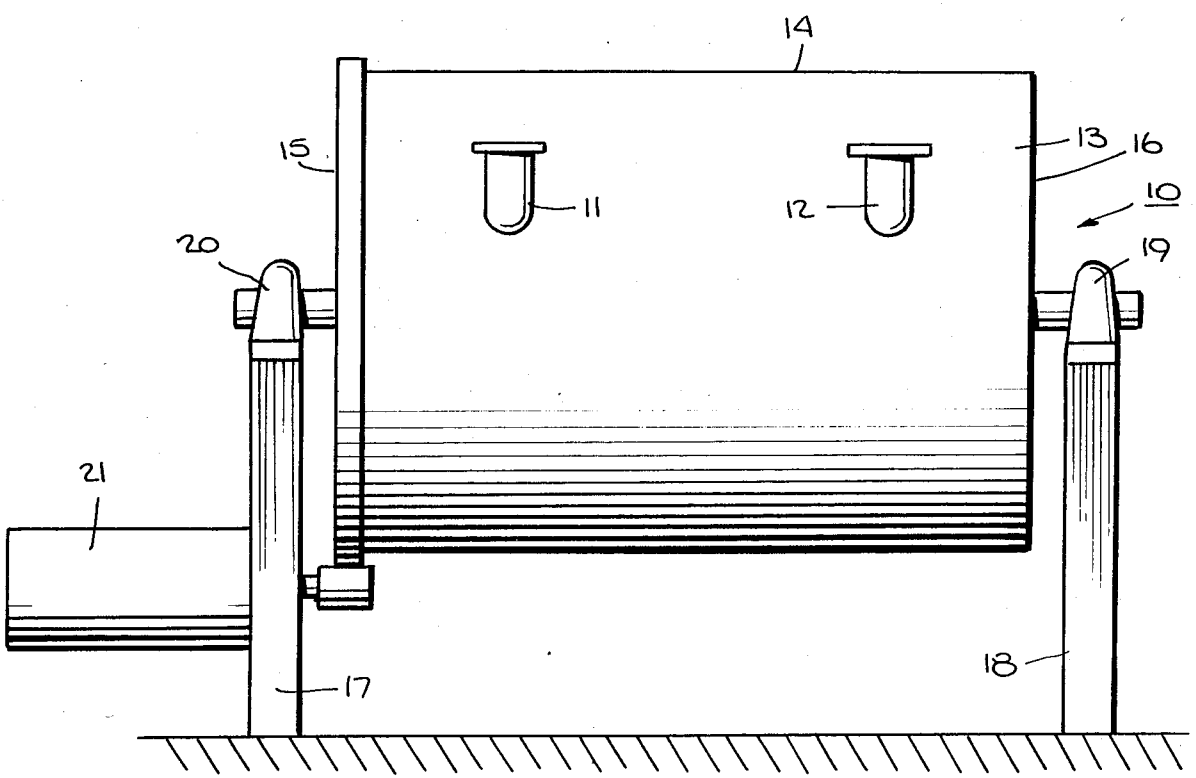
FIG. 1 is a schematic diagram of a rotary mill showing multiple loading means in position for charging the mill in accordance with the present invention.
Figure 3:
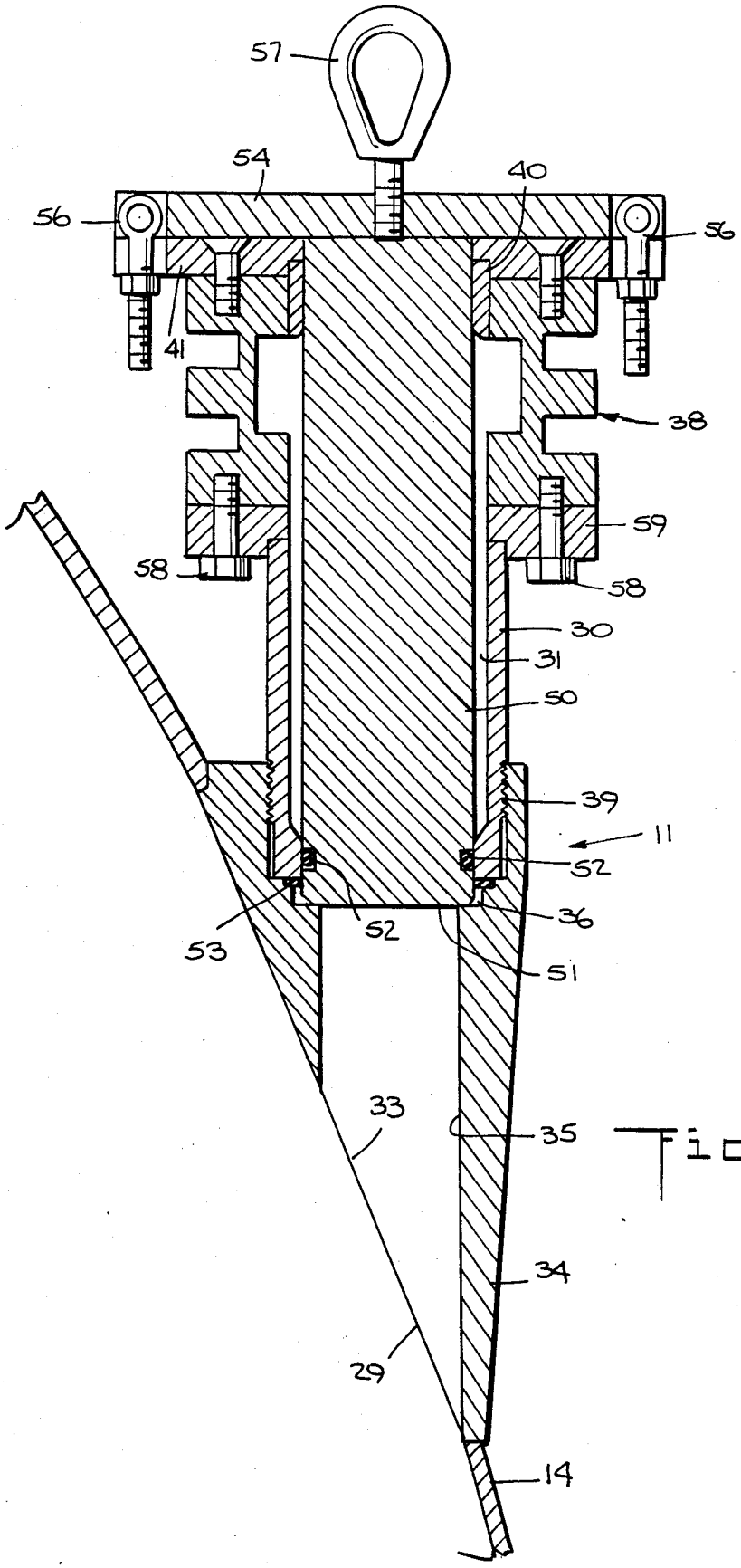
FIG. 3 is a version of a loading assembly of the present invention during the "operating" mode.
Figure 4:
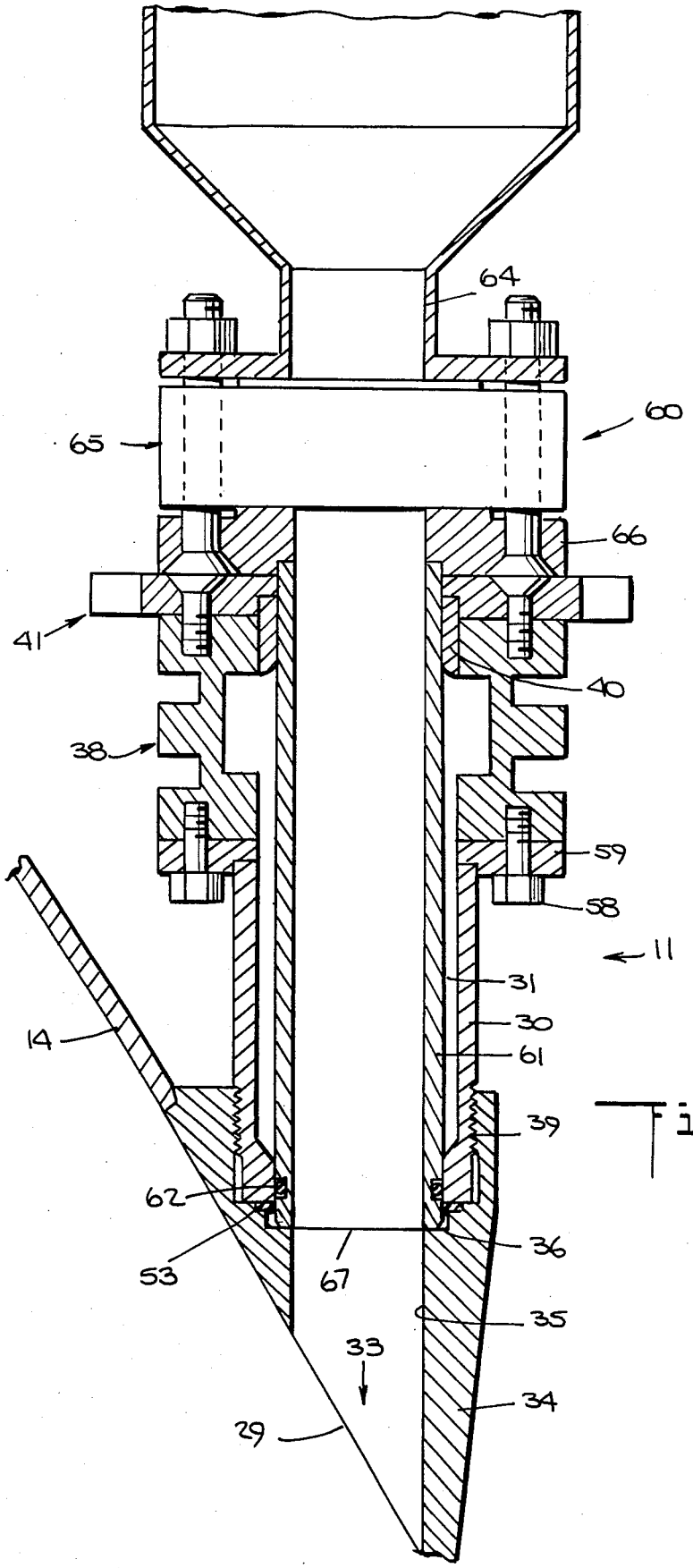
FIG. 4 is a version of the loading assembly of the present invention during the "Charging" mode.

Referring to the drawing, FIG. 1 shows schematically a ball mill 10 with the charging system comprising a pair of loading means 11 and 12 in position for loading. The ball mill comprises a cylindrical shell 13 mounted for rotation around a substantially horizontal axis. The shell is comprised of a peripheral wall 14, two ends 15 and 16 and two orifices (concealed, respectively, by the loading means 11 and 12) in the peripheral wall for charging material into the shell. Support members 17 and 18 for the mill, trunnion bearings 19 and 20 and the drive means 21 are represented schematically. The grinding media, internal parts of the mill, means for establishing a controlled environment in the mill, and discharge device are not shown. Loading means 11 and 12, which are sealably secured over the charging orifices (not shown in FIG. 1), are in essentially vertical position when they are on the side of the mill, and in this location are in position for loading. A schematic version of a loading means, valve means and an upper sealing tube means are shown in FIG. 2. Details of the loading assembly in the "operating" mode and in the "Charging" mode are shown in FIGS. 3 and 4, respectively. In FIG. 3 a removable plug member 50 is positioned in the loading means, and in FIG. 4 a charging tube assembly 60 is positioned in the loading means. The details in FIGS. 2, 3 and 4 comprise a loading assembly for charging the mill.

FIG. 2 shows the loading means 11 mounted on the peripheral wall 14 of shell 13 over charging orifice 29. The loading means comprises a loading conduit 30, which is essentially a central longitudinal channel 31 with a loading port 32 at one end and an exit port 33 at the other. The exit port 33 is aligned with charging orifice 29 in the shell wall for unencumbered passage of feed material into the shell. Shell adapter 34, the end portion of the loading means, is sealed over the orifice. The outer configuration of the shell adapter 34 is frusto-conical. The inner wall 35 of the frusto-conical portion of the loading means has a recess 36, which serves as a seat for the interchangeable insertable members of the loading assembly. The loading means 11 is sealably secured on the shell wall 14 over the charging orifice 29 in the shell. Slide gate valve 37 (alternatively, a butterfly or other appropriate valve) in housing 38 is incorporated with the loading conduit. To permit installation of the valve and generally for convenience in assembly, the loading means is constructed of separate members, which are sealably connected, e.g. by threaded engagement at juncture 39. Valve 37 is provided in the loading means to enable the sealing of the loading means and shell from the atmosphere when installing and removing the plug member or charge tube assembly shown, respectively, in FIGS. 3 and 4. An upper sealing tube 40 having flange 41 is provided as a retaining means for the removable plug and charging tube members during interchange of the removable parts. Upper sealing tube 40 provides additional sealing means in the loading assembly.

In FIG. 3, which shows a loading assembly of this invention in the "operating" mode, a removable plug member 50 is slidably disposed in the loading conduit channel 31 of the loading means, recess 36 forming a seat for the base 51 of the plug. "O" ring 52 and seal 53 serve to seal the loading conduit from the atmosphere. Closure cap 54, securably attached to plug member 50, is secured on the flange 1 of the upper sealing tube 40 with swing bolts 56. A lifting means 57 is provided to retract the plug. The housing 38 for valve 37 (not shown in FIG. 3) associated with loading conduit is secured to the loading means by bolts 58 in flange 59.

In FIG. 4, which shows a loading assembly of this invention in the "Charging" mode, charging tube assembly 60 is inserted in loading means 11. Charging tube assembly 60 comprises a nozzle end 61 at one end, a charge container 64 at the opposite end, a charge container valve member 65, adapter flange 66 and sealing means, comprising "O" ring 62. The charging tube assembly 60 is removable and insertable into assembly loading means 11. The nozzle end 61 is slidably insertable in loading conduit channel 31, with the base 67 of the nozzle end seated in recess 36 and adapter flange 66 seated on flange 41. "O" ring 62 and seal 53 serve to secure the charging tube in a sealable relationship with respect to the atmosphere. The charging tube and charging container assembly is removed as a unit after charging the shell, as explained below.

To charge the mill through loading means 11 and 12 the desired environment is established in the shell (by means not shown) with the plug members in place. FIG. 3 shows plug member 50 in loading means 11 and the loading means is positioned as shown in FIG. 1, i.e. on the side of the mill, so that it is vertical. Swing bolts 56 are loosened and plug member 50 is retracted to a position just above valve 37 so that "O" ring 52 is in contact with upper sealing tube 40. Valve 37 is closed, thereby sealing the loading tube from the air. Plug member 50 is removed while the conduit valve 37 in the loading means is closed. Charge tube assembly 60 is inserted in the loading conduit so that "O" ring seal 62 seals with upper sealing tube 40. Valve 37 is opened, the charging tube is inserted completely into the loading conduit 31. The charge container valve member 65 is opened and the material in the charge container 64 is permitted to flow into the shell 13 via loading conduit 30 through orifice 29. When the material is loaded the charge tube assembly is removed and replaced by the plug member by reversing the procedure. The loading chamber is maintained sealed from the atmosphere after the feeding device is removed so that on reloading of the mill the charge material will not be contaminated.

The mill shell may be, for example, cylindrical, spherical, double or single conical, multi-flat sided, etc. The exact shape of the mill shell is not critical to the invention. Mills may also be double walled (or jacketed) for mill shell cooling. Water or other cooling media may be passed through this space (or jacket). Many varieties of mills and mill adaptations may be used, but it will be appreciated that these adornments are not a factor in this invention. The loading means may be sealably mounted on the outer side of the shell with, e.g. a flange. The grinding media may be, for example, balls, pebbles, rods, or other appropriate devices.

In the embodiment shown in the drawing the mill shell is rotated about an essentially horizontal central axis. In another embodiment of the invention the charging system is adapted for placement on a mill with the drum operated to rotate about a non-horizontal axis.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A method for charging material under seal from the atmosphere to a batch-type grinding mill, said mill comprising a rotatably mounted shell having a peripheral wall, means to rotate the shell, a plurality of grinding media within the shell, said mill being operable under a predetermined environment and under seal from the atmosphere, the method comprising:

a. providing the mill with a charging system comprising: at least one charging orifice located in said shell and loading means sealably secured on the peripheral wall of the shell over each charging orifice respectively, each of said loading means comprising a loading conduit with a port of entry at one end and an exit port at the other end, the exit port being aligned and forming a passageway with each orifice respectively for charging material into the shell, and each of said loading means being disposed on the shell to have a substantially vertical loading position when located at the side of the mill with the port of entry essentially above the exit port, thereby providing substantially unencumbered charging path for charge material through the loading means into the shell, and each of said loading means being part of a loading assembly comprising in addition to said loading means a removable sealable plug member for insertion into the loading means in a sealed relationship therewith relative to the atmosphere, a removable, sealable charge tube assembly for insertion into the loading means in sealed relationship therewith relative to the atmosphere, and a loading conduit valve means for sealing the loading means from the atmosphere in the absence of sealing by the plug member and charge tube assembly, thereby permitting interchange of the removeable plug and removable charge tube assembly without breaking the seal in the loading means with respect to the atmosphere; and b. charging material to the mill using at least one of said loading assemblies;

c. sealing the plug member in the loading means;

d. with the plug member sealed in the loading means, establishing the predetermined environment in the mill;

e. positioning the shell so that the port of entry of the loading conduit is essentially above the exit port;

f. opening the loading conduit valve;

g. retracting the removable, sealable plug member to a sealed position in a retaining section above the loading conduit valve means;

h. closing the loading conduit valve;

i. replacing the removable, sealable plug member in the retaining section with the removable sealable charge tube assembly, the charge tube assembly containing the charge material under seal and now being in sealed relationship with the retaining section of the loading means;

j. opening the loading conduit valve and releasing the seal in the charge tube assembly to flow from the charge tube assembly into the shell; and k. replacing the charge tube assembly with the plug member.

2. A method according to claim 1, wherein the charge material comprises at least selected one of the elements selected from the group consisting of nickel, copper, zinc, titanium, zirconium, niobium, carbon, silicon, molybdenum, vanadium, tin, aluminum, chromium, magnesium, lithium, iron, yttrium and rare earth metals.

3. A method according to claim 1, wherein the charge material is processed under controlled environmental conditions to produce a mechanically alloyed powder.

4. A method according to claim 1, wherein the charge material comprises aluminum.

5. A method according to claim 1, wherein the charge material comprises as a major constituent at least one of the elements selected from the group consisting of nickel, copper, iron and aluminum.

6. A mill comprising: (a) a rotatably mounted hollow shell, (b) at least one charging orifice in said shell and (c) a loading assembly secured on the shell over each charging orifice, said loading assembly comprising with respect to each charging orifice respectively, (1) a loading means comprising with respect to each orifice respectively, a loading conduit with a port of entry at one end and an exit port at the other end, the exit port being aligned and forming a charge passageway with each orifice respectively, said loading means being disposed on the shell so that it has a substantially vertical loading position when located at the side of the mill with the port of entry essentially directly above the exit port, thereby providing a substantially unencumbered charging path for charging material into the shell;

(2) a removable sealable plug member for insertion into the loading means in a sealed relationship therewith relative to the atmosphere;

(3) a removable, sealable charge tube assembly for insertion into the loading means in sealed relationship therewith relative to the atmosphere; and (4) a loading conduit valve means for sealing the loading means from the atmosphere in the absence of sealing by the plug member and cahrge tube assembly, thereby permitting interchange of the removable plug and removable charge tube assembly without breaking the seal in the loading means with respect to the atmosphere.

7. A mill according to claim 6, wherein the hollow shell has a peripheral wall and the at least one charging orifice is located in the peripheral wall of the shell.

8. A mill according to claim 6, wherein the loading means has a central longitudinal inner channel, and an inner wall fitted with a recess, the plug member has a base portion for slidable insertion into the loading means and the loading tube assembly has a base portion for slidable insertion into the loading means, and wherein the recess in the wall of the inner channel of the loading means serves as a seat for the base portion of the plug member and loading tube assembly.

9. A mill according to claim 6, wherein the loading conduit is provided with a retaining section ahead of the loading valve means, and said retaining section is provided with sealing means for maintaining the plug member and charge tube assembly in sealed relationship relative to the atmosphere.

10. A mill according to claim 6, wherein the charge tube assembly comprises a nozzle at one end, a charge container at the opposite end, a charge container valve member and sealing means for retaining the charge tube assembly in sealed relationship with the loading means relative to the atmosphere.

11. A batch-type rotary mill for grinding powder under controlled environmental conditions comprising a hollow rotatably mounted shell having a peripheral wall, a plurality of grinding media in the shell, means to rotate the shell, at least one charging orifice in said peripheral wall of the shell through which charge material can be apssed into the shell and a loading assembly for charging material into the shell, said loading assembly comprising: loading means sealably secured on the shell over each charging orifice, said loading means comprising a loading conduit with a port of entry at one end and an exit port at the other end, the exit port being aligned and forming a passageway with each orifice respectively for charging material into the shell, and said loading means being disposed on the shell to have a substantially vertical loading position when located at the side of the mill with the port of entry essentially above the exit port; a removable sealable plug member for insertion into the loading means in a sealed relationship therewith relative to the atmosphere; a removable, sealable charge tube assembly for insertion into the loading means in sealed relationship therewith relative to the atmosphere; and a loading conduit valve means for sealing the loading means from the atmosphere in the absence of sealing by the plug member and charge tube assembly, thereby permitting interchange of the removable plug and removable charge tube assembly without breaking the seal in the loading means with respect to the atmosphere.

12. A batch-type rotary mill according to claim 8, wherein the grinding media is balls and the charge material comprises at least one of the elements selected from the group consisting of aluminum, lithium, magnesium, titanium, yttrium, and rare earth metals.

* * * * *